US008436847B2

(12) United States Patent
Marhefka et al.

(10) Patent No.: US 8,436,847 B2
(45) Date of Patent: May 7, 2013

(54) VIDEO RATE CHLCD DRIVING WITH ACTIVE MATRIX BACKPLANES

(75) Inventors: Duane Marhefka, Winona, OH (US); Xiao-Yang Huang, Solon, OH (US)

(73) Assignee: Kent Displays Incorporated, Kent, OH (US)

( * ) Notice: Subject to any disclaimer, the term of this patent is extended or adjusted under 35 U.S.C. 154(b) by 722 days.

(21) Appl. No.: 12/629,243

(22) Filed: Dec. 2, 2009

(65) Prior Publication Data

US 2011/0128265 A1 Jun. 2, 2011

(51) Int. Cl.
*G09G 5/00* (2006.01)
*G09G 3/36* (2006.01)

(52) U.S. Cl.
USPC ..... 345/211; 345/87

(58) Field of Classification Search ..... None
See application file for complete search history.

(56) References Cited

U.S. PATENT DOCUMENTS

| | | | | |
|---|---|---|---|---|
| 6,154,190 | A * | 11/2000 | Yang et al. | 345/94 |
| 6,510,138 | B1 * | 1/2003 | Pannell | 370/236 |
| 6,911,965 | B2 * | 6/2005 | Miller, IV | 345/94 |
| 6,928,271 | B2 | 8/2005 | Fish et al. | |
| 7,190,337 | B2 * | 3/2007 | Miller et al. | 345/87 |
| 7,317,437 | B2 * | 1/2008 | Huang et al. | 345/87 |
| 7,432,895 | B2 | 10/2008 | Mi | |
| 7,737,928 | B2 * | 6/2010 | Huang et al. | 345/87 |
| 2009/0189847 | A1 | 7/2009 | Hughes et al. | |

FOREIGN PATENT DOCUMENTS

| | | |
|---|---|---|
| JP | 2001235766 | 8/2001 |
| KR | 20020095167 | 12/2002 |
| WO | 0229775 A1 | 4/2002 |
| WO | 02086855 A1 | 10/2002 |
| WO | 2006051275 A2 | 5/2006 |
| WO | 2006136799 A1 | 12/2006 |

OTHER PUBLICATIONS

Novatek, "NT7705: 160 Output LCD Segment/Common Driver", Ver 1.0, pp. 1-33.

Supertex, Inc., "HV66: 32-Channel LCD Driver with Separate Backplane Output", Supertex Doc. #: DSPD-44PLCCPJ, Version D092408, JEDEC Registration MS-018, Variation AC, Issue A, Jun. 1993.

* cited by examiner

*Primary Examiner* — K. Wong
(74) *Attorney, Agent, or Firm* — Pearne & Gordon LLP

(57) ABSTRACT

A device and method providing a pixel architecture that, in at least one embodiment, contains both an on/off memory element and a switching element to utilize low-power liquid crystal displays for video or near-video applications. Such an embodiment can be implemented, for example, using a pair of TFTs for implementing the memory element and switching element on a common substrate. Other embodiments can utilize actual memory devices for the memory elements. This device and method are particularly useful for driving cholestric display elements for video or near video rate applications.

34 Claims, 8 Drawing Sheets

VIDEO RATE CHLCD DRIVING WITH ACTIVE MATRIX BACKPLANES

BACKGROUND OF THE INVENTION

This application relates generally to a device and method providing a new pixel architecture that contains both an on/off memory element and a switching element to utilize low-power liquid crystal displays for video or near-video applications.

It would be useful to produce cholesteric liquid crystal displays on flexible active matrix backplanes. Such devices would provide the potential for video rate applications in addition to the traditional low power benefits of bistable reflective displays. However, there are numerous obstacles to achieving a video rate display using conventional techniques, and thus it would be useful to provide solutions using a new pixel architecture that solves the problems of the prior art designs for utilization with bistable liquid crystal displays.

Conventional AMLCD Background

The gray level displayed at a pixel of a conventional twisted nematic (TN) liquid crystal display (LCD) is a function of the applied voltage. Voltages of approximately ±5V drive a pixel black, with brightness increasing nonlinearly as voltage amplitude decreases. As such, the frontplane voltage ($V_{COM}$) is typically set to around 5V. A source data driver is used that can provide data in the range (0 to $V_{COM}$) or ($V_{COM}$ to $2V_{COM}$) to a pixel depending on the frame and desired gray level. The two frames are used to provide the required DC balance. The maximum voltage possible ($2V_{COM}$) is typically up to about 18V.

In a traditional active matrix display, a single thin film transistor (TFT) is used at each pixel in order to set the voltage on the pixel for a given frame. The gates of all the TFTs in a display row are connected to a common input, while the sources of all TFTs in a column are connected to a common input. In the course of a single frame, the gates of each TFT row are turned 'ON' in succession for a duration of $T_{LINE}=T_{FRAME}/N$, where $T_{FRAME}$ is typically 1/60 Hz=16.7 ms and N is the number of rows in the display. The pixels in the row whose TFT gates are 'ON' are charged through the TFTs to the data voltage on the corresponding column for a duration of $T_{LINE}$. The pixel is undriven and holds it voltage, generally with the assistance of a storage capacitor, for the remainder of $T_{FRAME}$.

The TFT gate drivers may drive 'OFF' gates with approximately −5V and 'ON' gates with approximately +30V. This permits the 'OFF' TFTs be driven off by at least $V_{GS}=-5V$ (=−5V-0V) and the 'ON' TFTs to be driven on by at least $V_{GS}=20V$ (=30V-10V). The TFTs are turned on very hard because 20V is much greater than the TFT threshold voltages. This permits $T_{LINE}$ to be low, which supports high frame rates ($T_{FRAME}$ small) on large displays (N large).

Video Rate ChLCD Drive Waveforms

A Cholesteric LCD (ChLCD), which is a bistable LC technology, requires fundamentally different driving waveforms than does a conventional LCD. In particular, the ChLCD appears dark while the drive voltage is on a pixel. Only after the voltage is removed does the pixel relax to a brighter appearance. ChLCD can be configured to provide power consumption improvements over traditional displays, but an effective active matrix driver for such displays for video or near-video applications is wanting. Desired is a method and apparatus for actively driving a ChLCD device to support higher refresh rates, such as for supporting video applications, while providing potential power saving benefits associated with ChLCDs.

SUMMARY OF THE INVENTION

Provided are a plurality of embodiments the invention, including, but not limited to, a number of methods for driving a display, such as a bistable cholesteric display, utilizing the device embodiments disclosed in this disclosure.

Also provided is a display device comprising: a plurality of individually driven display elements; and a plurality of driving elements, each one of the driving elements for driving a corresponding one of the display elements. Each one of the driving elements including: a storage element for storing an on/off state; and a switching element connected to the associated display element for connecting the associated display element to a source voltage, the connecting based on the state of the storage element. The source voltage can be varied between at least two different voltages during an update of a state of the associated display element.

Further provided is a display device comprising: a plurality of individually driven display elements; and a plurality of driving elements arranged as a matrix, with each one of the driving elements provided for driving a corresponding one of the display elements. Furthermore, each one of the driving elements includes: a first thin-film transistor for storing an "ON" or "OFF" state; and a second thin-film transistor connected to the associated display element for connecting the associated display element to a source voltage, with the connecting based on the "ON" or "OFF" state stored by the first transistor.

Still further provided is a display device comprising: a plurality of individually driven display elements; and a plurality of driving elements, with each one of the driving elements for driving a corresponding one of the display elements. Each one of the driving elements includes: a first input; a second input; a storage element for storing an on/off state for at least a certain period of time, where the on/off state is based on data provided at the first input and second input; and a switching element including an input connected to a voltage source, the switching element provided for driving the associated display element based on the state of the storage element such that, when the storage element transitions to an "ON" state, the switching element connects a voltage source to the associated display element to apply a charge to the associated display element, whereas, when the storage element thereafter transitions to an "OFF" state, the switching element removes the voltage source from the associated element of the display while substantially maintaining the charge on the display element.

Also provided is a display device comprising: a plurality of cholesteric liquid crystal display elements arranged as a matrix of columns and rows; and a plurality of driving elements, each one of the driving elements for driving a corresponding one of the display elements. Each one of the driving elements includes: a storage element for storing an "ON"/"OFF" state for at least a certain period of time, with the storage element having a column input and a row input, where the on/off state is based on a signal provided at the column input and a different signal provided at the row input. The driving elements also including a switching element for driving the associated display element based on the state of the storage element, such that, when the storage element is storing an "ON" state, the driving element applies a selected voltage source across the associated element of the display, whereas when the storage element is storing an "OFF" state, the switching element removes the selected voltage source from the associated element of the display.

For the above embodiment, the column inputs of the storage elements of the plurality of driving elements that are in the same column are tied to a common column signal source, and the row inputs of the storage elements of the plurality of driving elements that are in the same row are tied to a common row signal source. The row signal sources and column signal sources are used to set the state of the storage elements to set a reflectance and/or transmittance of the corresponding display elements to generate a display image on the display.

Still further provided is a display device comprising: a plurality of individually driven display elements; and a plurality of driving elements, with each one of the driving elements for driving a corresponding one of the display elements. Further, each one of the driving elements includes: a first input; a second input; a storage element for storing an on/off state for at least a certain period of time, where the on/off state is based on data provided at the first input and second input; and a switching element including an input connected to a voltage source, with the switching element for driving the associated display element based on the state of the storage element such that, when the storage element transitions to an "ON" state, the switching element connects a voltage source to the associated display element to set a state of the associated display element, whereas when the storage element thereafter transitions to an "OFF" state, the switching element removes the voltage source from the associated element of the display while substantially maintaining the state of the display element.

Also provided are additional embodiments of the invention, some, but not all of which, are described hereinbelow in more detail.

BRIEF DESCRIPTION OF THE DRAWINGS

The features and advantages of the examples of the present invention described herein will become apparent to those skilled in the art to which the present invention relates upon reading the following description, with reference to the accompanying drawings, in which.

DETAILED DESCRIPTION OF THE EXAMPLE EMBODIMENTS

Figure 1A:
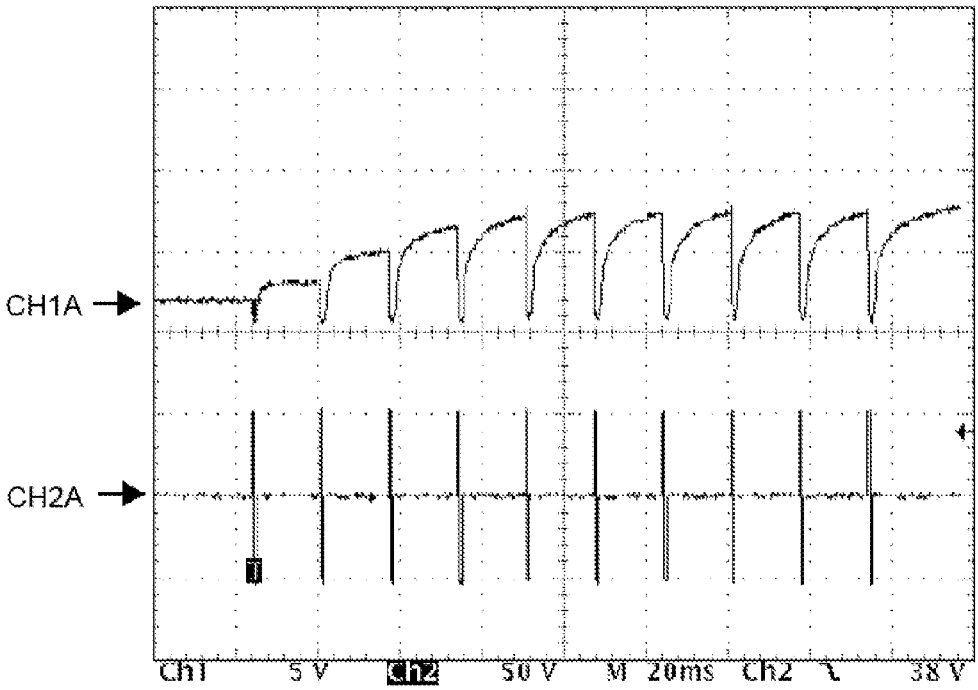
FIGS. 1A and 1B show a suitable drive pulses for a cumulative drive scheme for actively driving an ChLCD, with FIG. 1A showing the pulses for providing a Dark to Bright Transition of the ChLC material and FIG. 1B showing the pulses for providing a Bright to Dark Transition in the ChLC material.

This application discloses a device and a corresponding method providing a new liquid crystal (LC) pixel architecture that utilizes both an on/off memory element and a switching element to drive low-power liquid crystal displays for video or near-video applications. Note that various values provided herein having subscripts may be shown in the drawings without the use of subscripts.

A ChLCD requires fundamentally different driving waveforms than does a conventional LCD due to differences in needed drive voltages and crystal state transitions as compared to traditional LC displays. In particular, the ChLCD appears dark while the drive voltage is on a pixel. Only after the voltage is removed does the pixel relax to a brighter appearance. Therefore, a ChLCD requires drive pulses with relaxation periods in between to establish the desired reflectance. These pulses must be applied at a 60 Hz or greater rate such that the eye can integrate the reflected light profile without the appearance of flickering. A negative consequence of this pulsed operation is that the maximum time averaged reflectance from a pixel is reduced due to the lower reflectance while a pulse is applied and the time it takes the liquid crystal to relax to full reflectance after the pulse is removed. A drive scheme incorporating perturbation pulses (see WO 2006/136799, hereby incorporated by reference) has been developed to work around this limitation.

Cumulative Drive

Figure 1B:
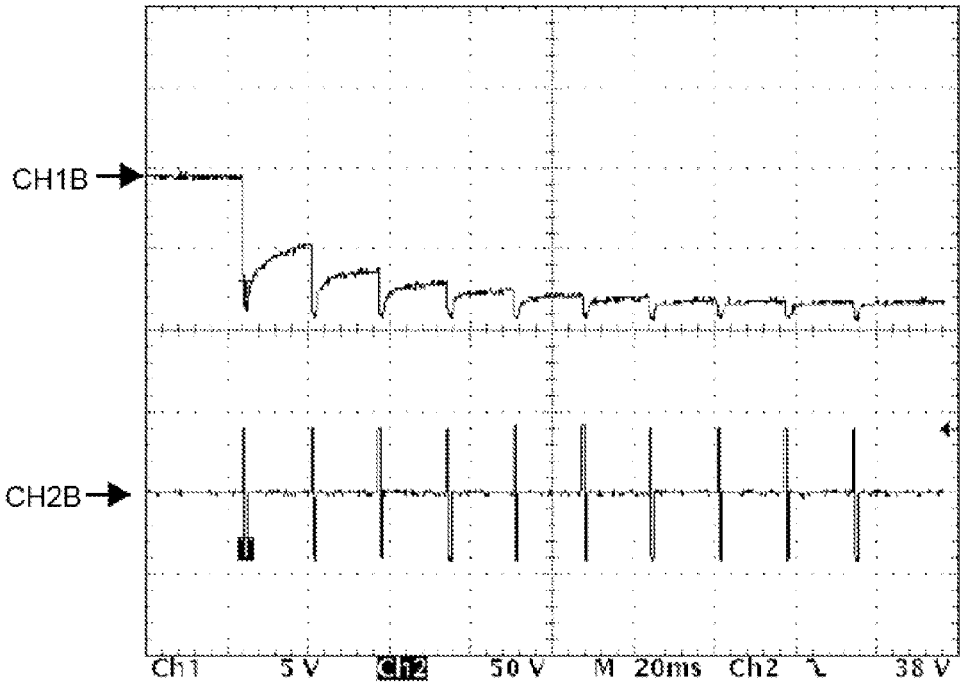

A cumulative drive scheme represents one suitable pulsed approach for actively driving an ChLCD. In this scheme, short pulses of up to a few milliseconds are applied at a desired rate, such as a 60 Hz rate. FIGS. 1A and 1B illustrate the approach. In the figures, channels CH1A and CH1B show the ChLCD reflectance under application of the 1 ms applied pulses on channels CH2A and CH2B, respectively. The 52V pulses in FIG. 1A transition the display from dark to bright, whereas the 40V pulse in FIG. 1B, with respective channels CH1B and CH2B, transition the display from bright to dark. A continuum of gray levels can be achieved by adjusting the RMS voltage of the applied pulses in FIGS. 1A and 1B between 40V and 52V using either amplitude modulation or a PWM scheme.

A few observations from FIGS. 1A, 1B are worth noting. First, it would typically require about 4 to 6 pulses for the worst case transitions to stabilize. At a pulse rate of 60 Hz, for example, a complete transition consisting of 6 pulses would require 100 ms. Second, a bright pixel that is being cumulatively driven will not appear as bright as a statically bright (undriven) pixel in current ChLCD technology. This is because a static pixel is always fully bright, so the time average of its intensity over a frame will be higher than that of a pixel that is pulsing bright under cumulative drive. Thus, selectively updating only the pixels that are changing may not be desirable in many applications. It would likely be preferable to continuously update all the pixels within a video window of the display or over the entire display to avoid having the undriven pixels being brighter than the driven pixels of a given desired brightness. Finally, it is worth noting that lower voltages may be utilized if the duration of the applied pulses are increased from 1 ms to a few milliseconds.

The cumulative drive scheme is also capable of producing bistable grayscale images. One could just stop the sequence of pulses (in between pulses) after the desired image has stabilized and the ChLC will relax to bistable gray levels. For the best bistable images, it may be desirable to adjust the gamma correction of the final pulses prior to stopping the pulse sequence.

Planar-Homeotropic PWM (P-H PWM)

Figure 2:
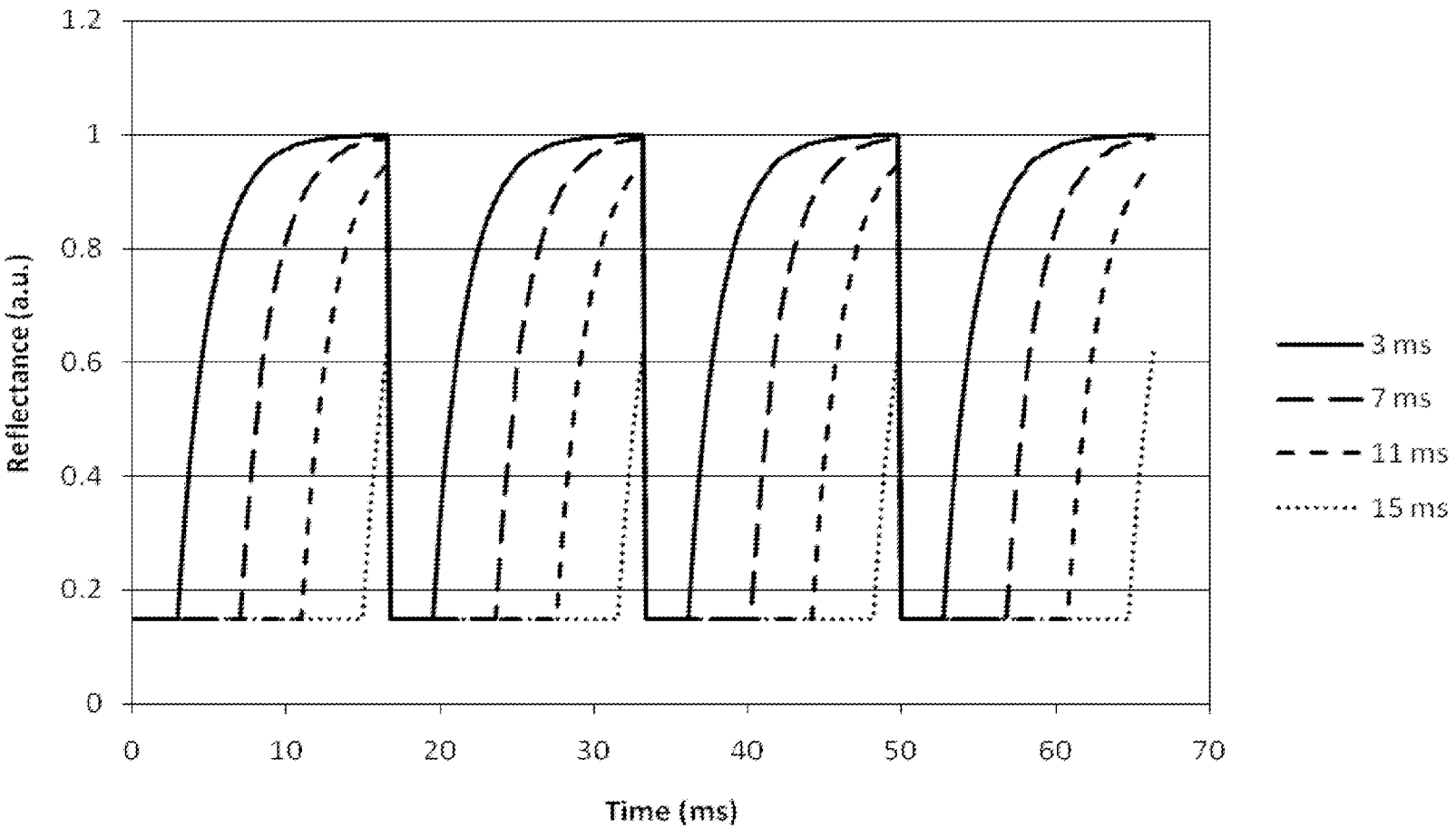
FIG. 2 shows a plot of reflectance versus time for a Planar-Homeotropic pulse width modulated (P-H PWM) drive scheme for actively driving an ChLCD.

A second drive scheme for providing video rates for ChLC displays involves the combined use of the planar and homeotropic textures. As in the cumulative drive scheme, pulses are applied at a desired rate, such as a 60 Hz rate, for example. However, the durations the pulses are applied determine the perceived gray levels. FIG. 2 illustrates this approach for pulses of four different widths between 3 ms and 15 ms. During the time the pulse is applied, the display is homeotropic and reflectance of the ChLC material is at a minimum. The ChLC material relaxes towards the bright planar state once the pulse is discharged. Clearly, the longer the duration the pulse is held during a 16.7 ms frame (1/60 Hz), the lower the integrated reflectance over the frame.

This drive scheme has a number of potential advantages over the cumulative drive approach described above. First, it is possible to change from one gray level to another in only a single frame rather than having to use multiple frames. Second, the TFT source drivers are not required to do amplitude modulation to implement grayscale. The method of implementing grayscale in cumulative drive by adjusting the RMS voltage of the applied pulses using amplitude modulation, noted above, requires TFT source drivers capable of performing such amplitude modulation. Third, gray levels may be more uniform, as the drive routine is not operating on the right-hand slope of the ChLCD electro-optic response curve. Gray level variations would be limited to differences in relaxation timing. And finally, contrast should be improved as holding the display in the homeotropic state produces darker blacks than the focal conic state used in cumulative drive scheme.

Implementation Issues

Numerous obstacles can arise in the implementation of the above video rate ChLCD drive schemes on the typical LCD active matrix backplanes employing the single transistor pixel architecture that is described in the Background. The first obstacle is the ability of the TFTs to charge/discharge the pixels to the required voltages within the available row select time, $T_{LINE}$, as limited by the number of rows, N, and the frame time, $T_{FRAME}$. In a conventional LCD, the drive voltages on a pixel change every $T_{FRAME}$=16.7 ms. However, in the ChLCD drive schemes, a new pulse is applied every 16.7 ms. This pulse must also be discharged within the same 16.7 ms interval. The P-H PWM scheme must be able to discharge the pixels at multiple points within a 16.7 ms interval in order to produce gray levels. Because the voltage on a pixel can only be changed once per frame in a standard one-transistor pixel architecture, this would suggest that $T_{FRAME}$ must be much lower than 16.7 ms for a ChLCD.

Unfortunately, at the same time that the ChLCD requires a shorter $T_{FRAME}$, it also requires a longer $T_{LINE}$. This is due to the higher drive voltage needs of the ChLCD and the voltage limits of the TFTs and drivers. For example, if 25V is to be provided across a ChLCD pixel and 30V is the maximum gate voltage, then $V_{GS}$ may be as little as 5V with $V_{COM}$ set to 0V. The TFTs would therefore barely be turned on as opposed to a conventional LCD where $V_{GS}$ will always be at least 20V. Thus, it may not be generally practical to scan the display fast enough to produce the required pixel waveforms with an amorphous silicon active matrix backplane employing a single transistor pixel architecture in the many cases where relatively high video rates are desired.

The higher voltage requirements of the ChLCD also present problems for DC balancing. In a typical LCD, the frontplane voltage $V_{COM}$ is set to the mid-value of the source driver, with the source driver outputting values above, and below, $V_{COM}$ (depending on the frame) to produce DC balance. However, given the relatively high voltage requirement of the ChLCD, the $V_{COM}$ voltage should be set to either 0V or the maximum the TFT can handle. Changing polarity then requires discharging all of the pixels before toggling $V_{COM}$ values in order to not damage the TFTs. This generally works well for the pulsed ChLCD methods because the $V_{COM}$ inversion can happen between pulses. However, in the P-H PWM scheme, the inversion means there must be a small time between the 16.7 ms periods during which the ChLCD cannot be held homeotropic, which limits the best dark state slightly.

Finally, the higher voltage requirements of ChLCDs exceeds the capabilities of commercially available TFT source drivers used for amplitude modulation of conventional LCDs. Such drivers typically have a maximum voltage $V_{MAX}$ of 18V and drive logic set for $V_{COM}=V_{MAX}/2$.

Accordingly, alternative TFT technologies with higher carrier mobilities, higher voltage TFT structures, and higher voltage drivers that could all help solve these problems, and thus provide viable alternatives, could be provided. But an alternative solution based on existing backplane technology and available drivers, with modifications, is proposed. In the following proposed solutions, the effects of switching to a new pixel architecture that provides both an on/off memory element and a switching element will be proposed as a more practical alternative for many applications, in particular those where the above described shortcomings are undesirable.

Improved Architecture

Because Cholesteric liquid crystal displays use pulsed drive waveforms for video rate driving, such waveforms can be difficult to generate with a single-transistor pixel architecture. In particular, the relatively higher voltage of a ChLCD vs. a TN LCD limits the gate bias of the TFTs with available LCD backplanes and drivers, while the pulsed waveforms require faster scanning of the TFT array. The fundamental issue is that the time to charge the LC capacitance becomes too long for the display to be scanned at the required rate to produce pulsed drive waveforms with the required timing. A new approach is provided that recognizes that this problem can be overcome if the ChLC capacitance can be charged in parallel, rather than sequentially, row by row. This is accomplished by the addition of a storage element (e.g., memory element) to control a switch at each pixel. This approach is capable of handling the DC balance of the drive waveforms by frame inversion. Additionally, the need for high voltage DAC-based source drivers is avoided. Accordingly, one or more of the above identified shortcomings are mitigated or eliminated.

Figure 3:
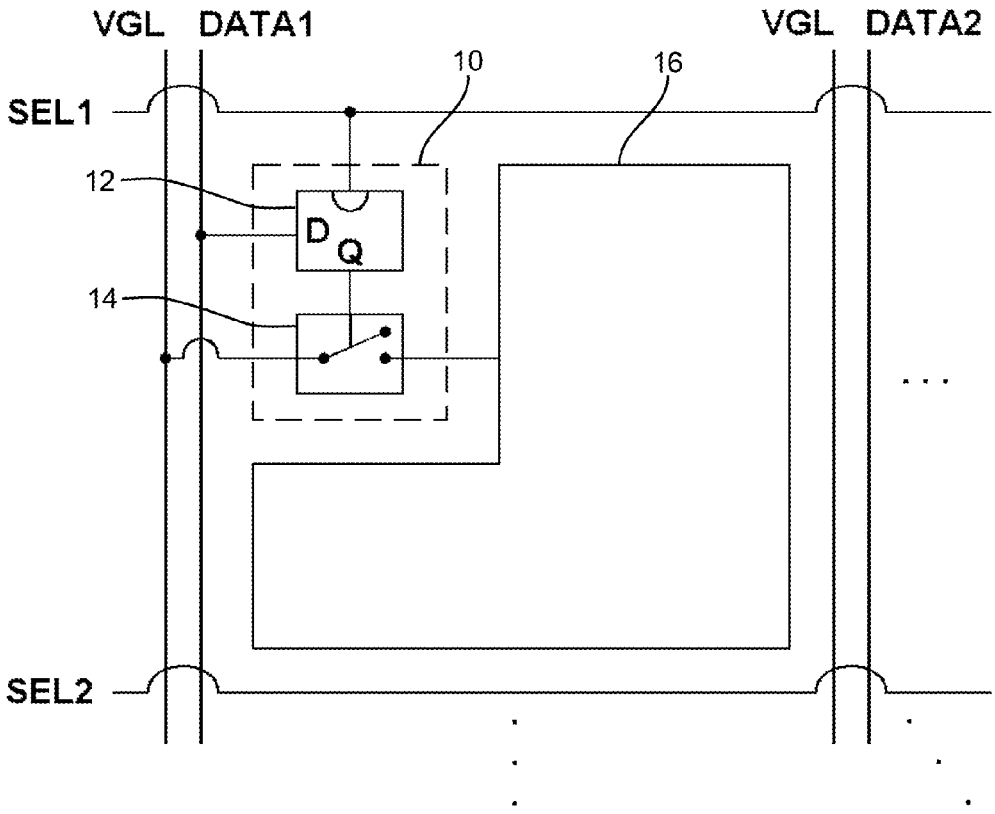
FIG. 3 shows a generic block diagram of a new pixel architecture for driving a display element showing a driving element having a storage element and a switching element driving a display element.

A block diagram of the new pixel architecture is provided in FIG. 3. At each display pixel there is at least one driving element 10 having an on/off storage element 12 and a switching element 14, and a display element 16 driven by a select line SEL1 and data line DATA1 for connecting the display element to $V_{GL}$.

Each individually driven display element in the array (which is typically an individual pixel, and will be so referenced below, although other arrangements of display elements can also be supported such as the use of a plurality of sub-pixels to implement, for example, color), is uniquely addressed by a select line SELn and a data line DATAm. The information on a pixel's data line is transferred to the pixel's corresponding storage element during the time that the pixel's select line is asserted. Thus, the storage element acts as a D-type latch. The output of the storage element controls the corresponding switching element, which either opens or closes a connection between the pixel electrode and a global signal designated $V_{GL}$. The memory elements of the entire array may be set to required values by scanning through the select lines one by one, with the data lines set accordingly for the selected row.

One potential advantage of this new architecture for generating pulsed waveforms is that the pixel electrodes for pixels whose memory elements hold the 'ON' state (switches closed) are charged concurrently, rather than sequentially by row as in the standard single-transistor architecture. This relaxes requirements for the speed of the switching element. Additionally, the time necessary to write a memory element can be made much shorter than the time necessary to charge a pixel electrode. These properties permit the select lines to be scanned much faster using this improved approach, in contrast to the single transistor cumulative and P-H PWM schemes disclosed above, and thereby enable the generation of pulsed drive waveforms.

Figure 4:
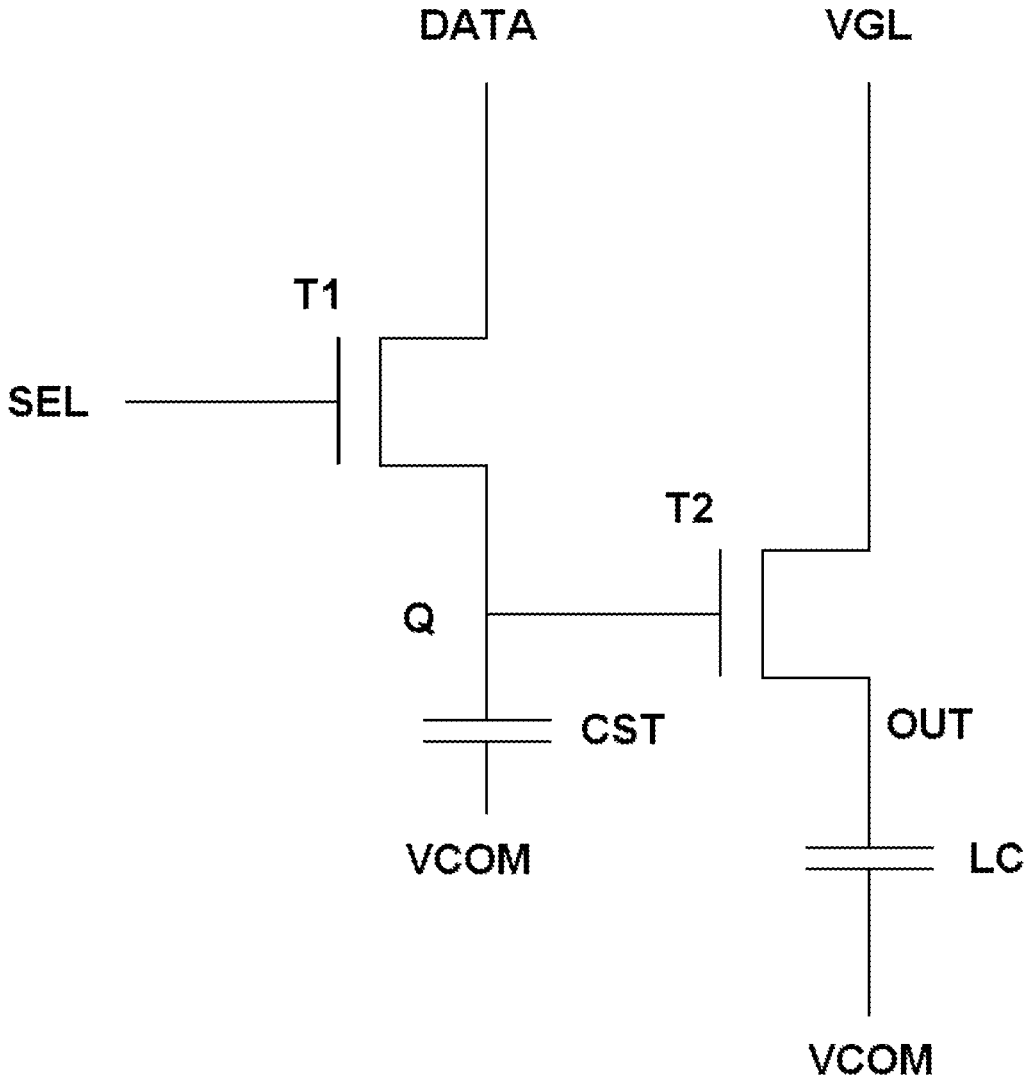
FIG. 4 shows a particular embodiment of the new architecture of FIG. 3.

One embodiment of the proposed architecture that is particularly suited to this implementation involves a driving element including a memory element comprised of a TFT (T1) connected to a capacitor (CST) for the storage element, and a second TFT (T2) used as the switching element. This embodiment is illustrated in FIG. 4. The gates of all the memory element TFTs (T1) in a given row are connected to a single select line (SEL), while the drains of all the memory element TFTs (T1) in a given column are connected to a single data line (DATA). The value on the data line is written to the storage capacitor (CST) during the time that the select line is asserted (i.e., T1 is turned on). This value (Q), which is capable of either turning on or off the switching element TFT (T2), is held on the storage capacitor (CST) until the next time that the row is selected.

The memory element TFT (T1) and storage capacitor (CST) are designed such that the time to charge the storage capacitor (CST) is much shorter than the duration required to charge the display element capacitance (LC) through the switching element TFT (T2), as shown in FIG. 4.

The $V_{COM}$ signal is the voltage provided on the counter-electrode for the liquid crystal. Therefore, the voltage across a pixel is the difference in voltage between the pixel electrode (OUT) and $V_{COM}$. This is shown in FIG. 4, where the LC in the pixel is represented by a capacitance. When used as the reference for the storage capacitor, the $V_{COM}$ signal should be globally routed. In some cases it may be possible to reference the storage capacitor to the select line of the previous row and thus avoid routing the $V_{COM}$ signal.

The $V_{GL}$ global signal is transferred to the pixel electrode (OUT) connected to the source of the switching element TFT (T2) whenever the switching element TFT (T2) is turned 'ON'. When the T2 transistor is turned 'OFF', the pixel electrode (OUT) is floating, and $V_{GL}$ may be changed with no affect on the pixel electrode voltage. $V_{GL}$ is then routed to all the pixels in the display.

Figure 5:
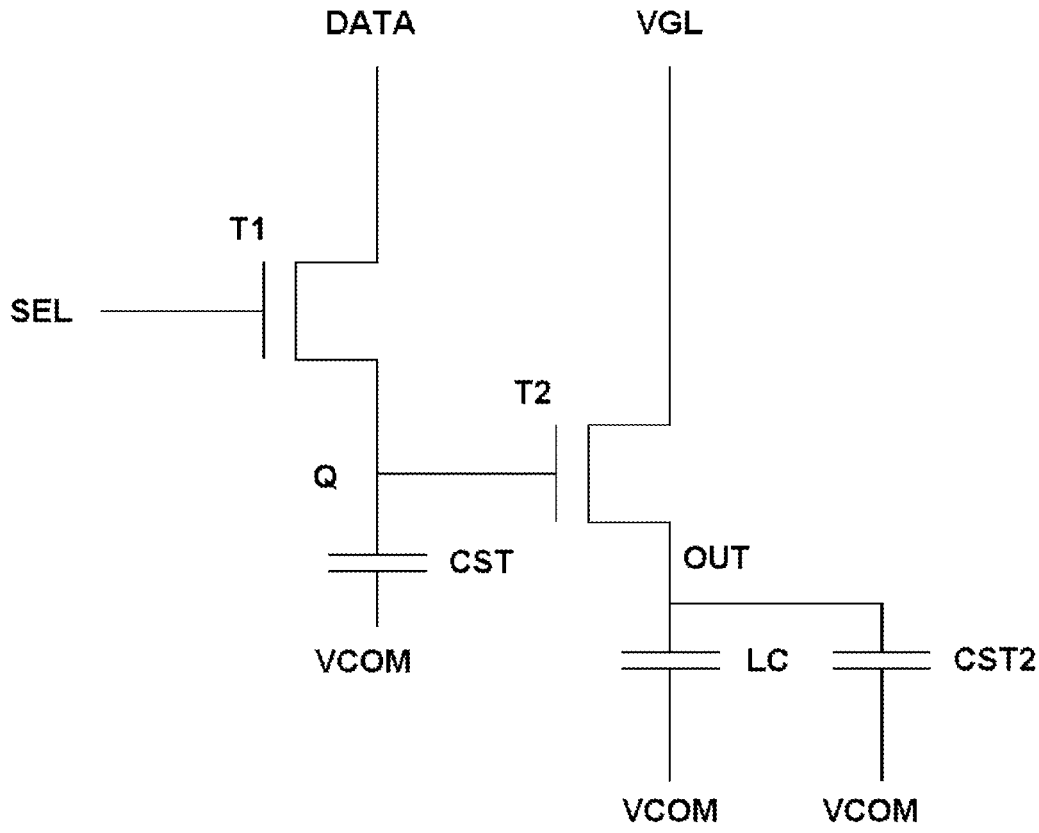
FIG. 5 shows an alternative embodiment of the new architecture of FIG. 3.

In some cases an additional storage capacitor may be desired to counter leakage currents and the dependence of the LC capacitance on the LC texture. The additional (optional) capacitor, CST2, is shown in the alternative embodiment of FIG. 5.

Two TFT Planar-Homeotropic PWM Implementation

Figure 6:
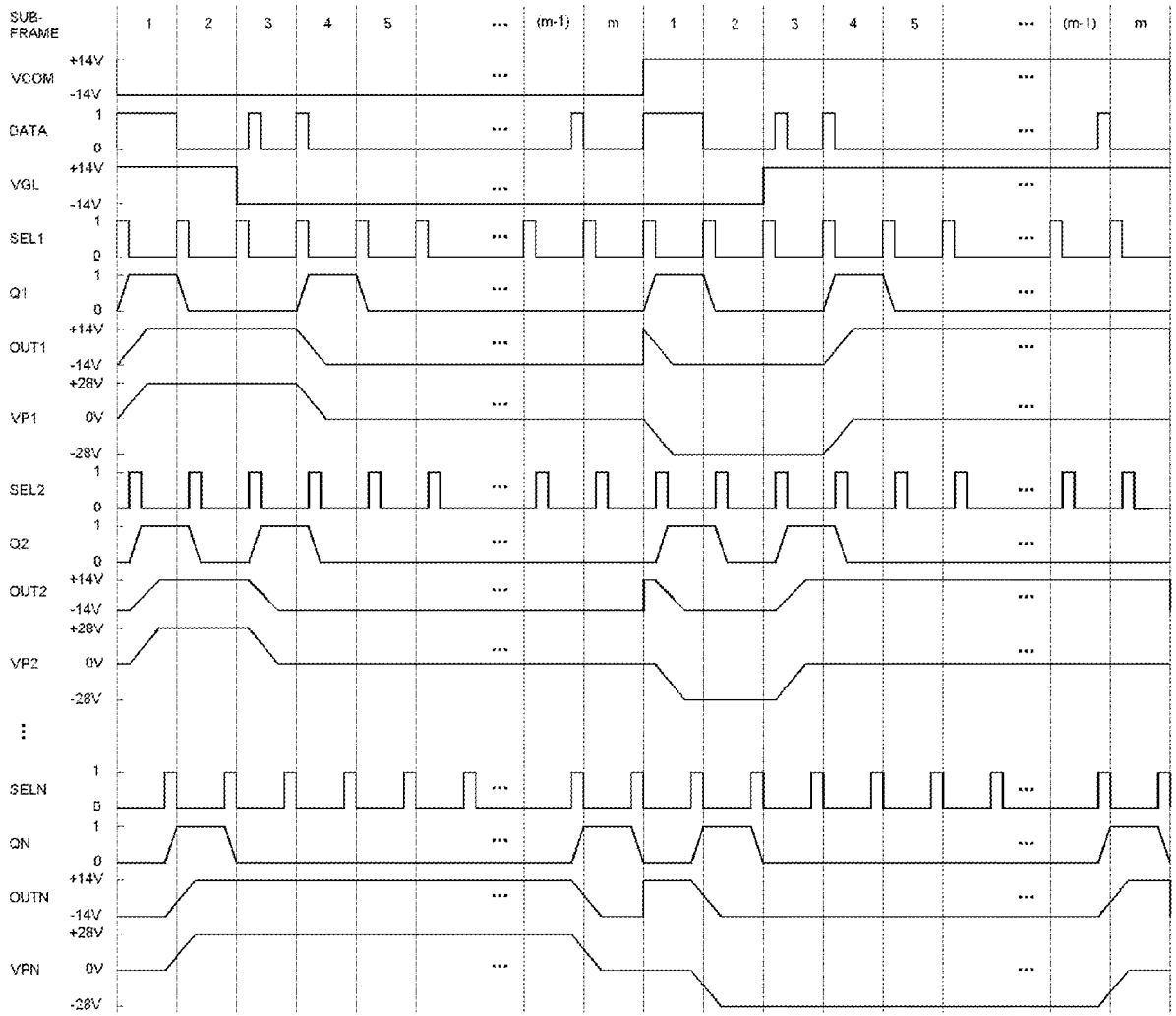
FIG. 6 provides one potential drive scheme for implementing a P-H PWM Drive embodiment using the new pixel architecture.

Implementation of the Planar-Homeotropic PWM (P-H PWM) drive scheme using the new pixel architecture is demonstrated in FIG. 6. Two frames are shown in order to demonstrate the frame inversion provided for dc balance. In the first frame, the frontplane voltage ($V_{COM}$) is set to a negative value, whereas in the second frame $V_{COM}$ is positive. A single 16.7 ms frame is divided into m subframes. During a single subframe, the select lines of all N rows (designated SEL1 through SELN) are successively enabled for a few microseconds. The line time, $T_{LINE}$, is thus given by the equation $T_{LINE}=T_{FRAME}/(m*N)$. Because $T_{FRAME}$ is fixed around 16.7 ms and $T_{LINE}$ will have a minimum value needed to write the memory element, $T_{LINE,MIN}$ the product of m*N is constrained as follows: $m*N \leqq T_{FRAME}/T_{LINE,MIN}$ . Each subframe is clearly designated in FIG. 6.

The DATA signal connects to all of the memory elements in a display column. In this example, only one column is demonstrated; however, it is a straightforward extension to address more columns by adding additional data signals. Note, however, that as more columns are added, $T_{LINE,MIN}$ may need to be increased to account for the RC delays down the select lines. During the time that a row is selected, the value on DATA is transferred to the output (Qn) of the corresponding memory element. The setting of the memory element is indicated with sloped lines (on Q1, Q2 . . . QN) in FIG. 6. When a row is not selected, the memory element output is unaffected by the value on the DATA signal.

The switching element is used to connect or disconnect the pixel electrode of the corresponding pixel to the global signal $V_{GL}$. The voltage on the pixel electrodes is indicated in FIG. 6 by the OUTn waveforms. When the switch is open, the pixel electrode is unaffected by the value on $V_{GL}$. Finally the voltage across a pixel ($V_{Pn}$) is equal to the difference between the pixel electrode and the frontplane voltage, $V_{COM}$.

The first two subframes are the same for all pixels in the display regardless of gray level. During the first subframe, DATA is always 1 (all memory elements are set output their switch on voltage) and $V_{GL}$ of opposite polarity to $V_{COM}$, such that all pixels are driven to the homeotropic state. During the second subframe, $V_{GL}$ is maintained and DATA is always 0 such that the memory elements are set to turn off their corresponding switching elements. Note that the voltage on the pixels is maintained such that they remain in the homeotropic state (and thus the charge across the pixel is also maintained). This is as is preferrable in the P-H drive scheme, where all pixels are initially driven to the homeotropic state and later discharged (to relax to the planar state) at specific times which correspond to the desired gray levels of the individual pixels. Also, $V_{GL}$ must be maintained because the last switching element isn't turned off until the end of the second subframe.

In all of the remaining subframes, the $V_{GL}$ signal is set to $V_{COM}$. This enables the discharging of the LC at the pixels as required to produce the transition to the bright planar state. The PWM control of gray level is then implemented by selecting the appropriate subframe in which to discharge the pixel LC. In FIG. 6, the pixel in the first row is discharged in subframe 4, the pixel in the second row is discharged in subframe 3 (brightest possible), and the pixel in row N is discharged in subframe (m-1) (darkest possible). Setting DATA to 1 during the select time of a given row in the desired subframe is all that is needed to begin the LC discharge. This turns on the corresponding switching element for a subframe duration, which drives the pixel electrode to $V_{GL}=V_{COM}$.

Subframe m is the same for all pixels in all rows. The DATA signal is 0 such that all of the switching elements are turned off. The subframe is provided to give time for the row N pixels to discharge before the inversion of $V_{COM}$ to begin the following frame. All pixels are typically discharged before the frame inversion, such that the change in $V_{COM}$ doesn't create a potentially damaging doubling of the voltage at the pixel electrodes through the LC capacitance.

Note that this drive scheme avoids the need for TFT source drivers capable of high voltage amplitude modulation.

Two TFT Cumulative Drive PWM Implementation

Figure 7:
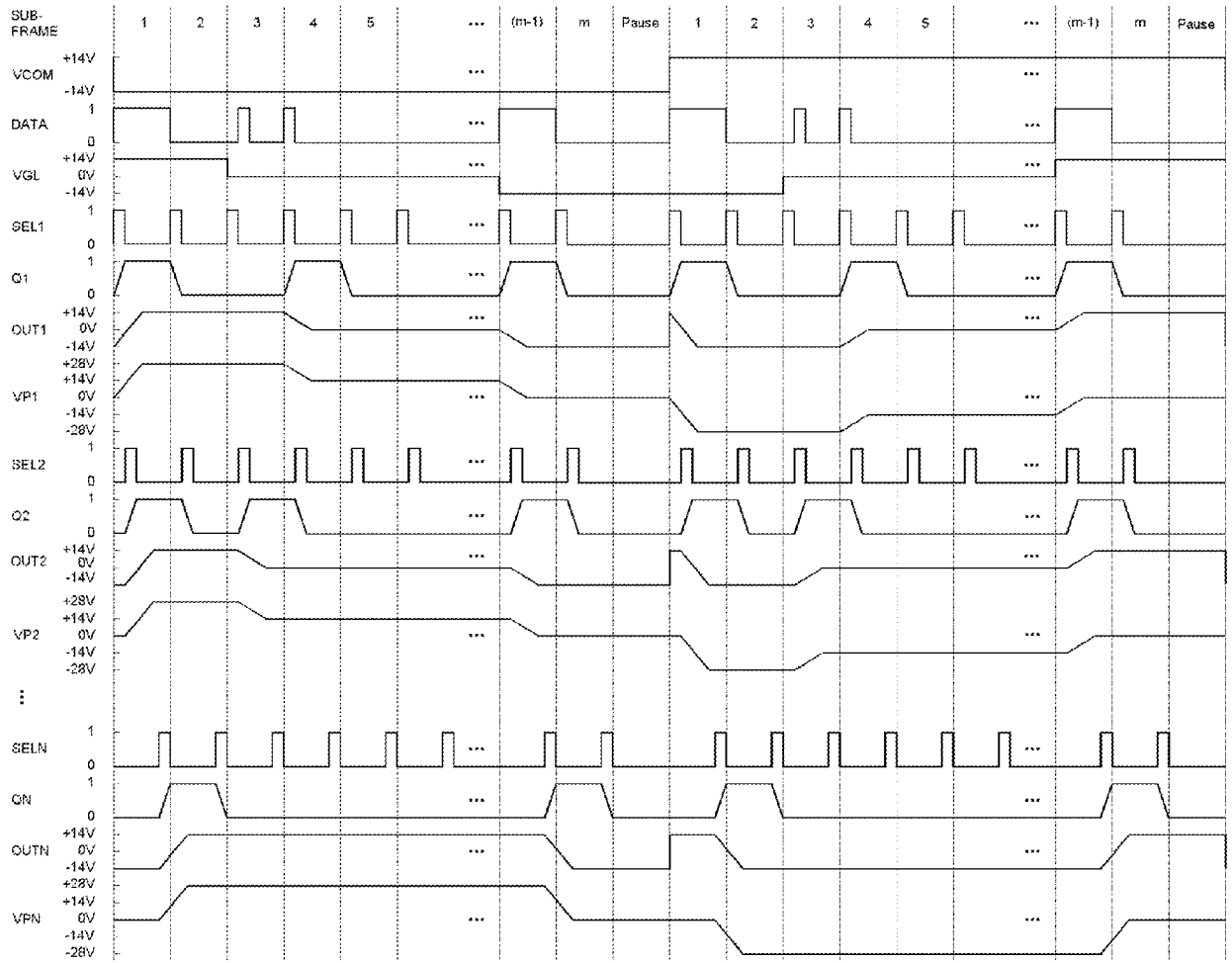
FIG. 7 provides another potential drive scheme for implementing a Cumulative PWM Drive embodiment using the new pixel architecture.

Implementation of the alternative Cumulative Drive PWM drive scheme using the new pixel architecture is demonstrated in FIG. 7. Note that the system of FIG. 7 is very similar as that provided in FIG. 6, with the difference being the waveforms generated on the pixels. As before, two frames consisting of m subframes each are used for the dc balance.

The first two subframes are the same for all the driven pixels in the display regardless of gray level in order to provide all pixels with a drive pulse in a simple manner. During the first subframe, DATA is always 1 (all switches turn on) and $V_{GL}$ of opposite polarity to $V_{COM}$, such that all pixels are driven to the planar drive voltage. During the second subframe, $V_{GL}$ is maintained and DATA is always 0 such that the switches are turned off. Note that the voltage on the pixels is maintained such that the pixels remain at the planar drive voltage (and thus stay charged). Also, $V_{GL}$ must be maintained because the switching elements in the last row aren't disabled until the end of the second subframe.

The $V_{GL}$ signal is set to a voltage for driving the LC pixel to focal conic for subframes 3 through (m-2). In this example, $V_{GL}$=0V is used to produce ±14V across the pixel. The PWM control of gray level is then implemented by selecting the appropriate subframe in which to discharge the pixel LC from ±28V to ±14V by driving the $V_{GL}$ voltage (0V) to the pixel electrode. In FIG. 7, the pixel in the first row is discharged in subframe 4, the pixel in the second row is discharged in subframe 3 (darkest possible), and the pixel in row N is discharged in subframe (m-1) (brightest possible). Setting DATA to 1 during the select time of a given row in the desired subframe is all that is required to begin the voltage change on the LC. Setting DATA to 0 during the select time of the following subframe then turns off the switching element.

Subframes (m-1) and m are the same for all pixels in all rows. The $V_{GL}$ signal equals $V_{COM}$ in these subframes, while DATA=1 in subframe (m-1) and 0 in subframe m. The effect is that all the switching elements are turned on in subframe (m-1) to discharge the LC to 0V and are subsequently turned off in subframe m as the discharge is complete.

The resulting pixel waveforms ($V_{P1}$, $V_{P2}$, and $V_{PN}$) in FIG. 7 show that a PWM between the planar (±28V) and focal conic (±14V) voltages is achievable. Note that a pause between subframe m of the current frame and subframe 1 of the following frame is provided to permit the LC material to relax.

Considering the case of 5 ms duration pulses within a 16.7 ms frame, it is evident that the drive electronics are idle for 11.7 ms of the frame during which the LC relaxes. Rather than sitting idle, it would possible for the backplane to address another N rows during 5ms of the idle time of the first N rows. Furthermore, this would still leave the backplane idle for 6.7 ms, of which another 5 ms could be used to address N more rows. Thus, with 5 ms drive pulses and a 16.7 ms frame, 3N rows can be driven by offsetting the pulses of three groups of N rows within the 16.7 ms frame. Offsetting the pulses thus permits addressing a larger display than would otherwise be possible.

Note that this drive scheme avoids the requirement for TFT source drivers capable of high voltage amplitude modulation. Standard electrophoretic TFT source drivers may be used, with the two voltage levels of a cumulative PWM scheme produced by changes on the $V_{GL}$ signal.

Amplitude Modulation Alternative Implementation

The new architecture can also be used to implement drive schemes based on amplitude modulation (AM) as well. A key feature is that the voltage on $V_{GL}$ may be written to any pixel electrode over the course of two subframes. In the first subframe, the memory elements of the pixels whose electrodes are to be set to $V_{GL}$ are set to turn on their corresponding switching elements. In the second subframe, the memory elements are set to turn off their corresponding switching elements. $V_{GL}$ is then free to change to another value for a new set of subframes. In this manner, a cumulative drive scheme based on amplitude modulation of pulses, rather than PWM, could be implemented. For example, in a four level scheme, gray level 0 (lowest voltage) pulses could begin in subframe 1, gray level 1 (higher voltage) pulses in subframe 3, gray level 2 (higher voltage still) pulses in subframe 5, and gray level 3 (highest voltage) pulses in subframe 7. The pulse discharge for the 4 levels would be similarly staggered.

Figure 8:
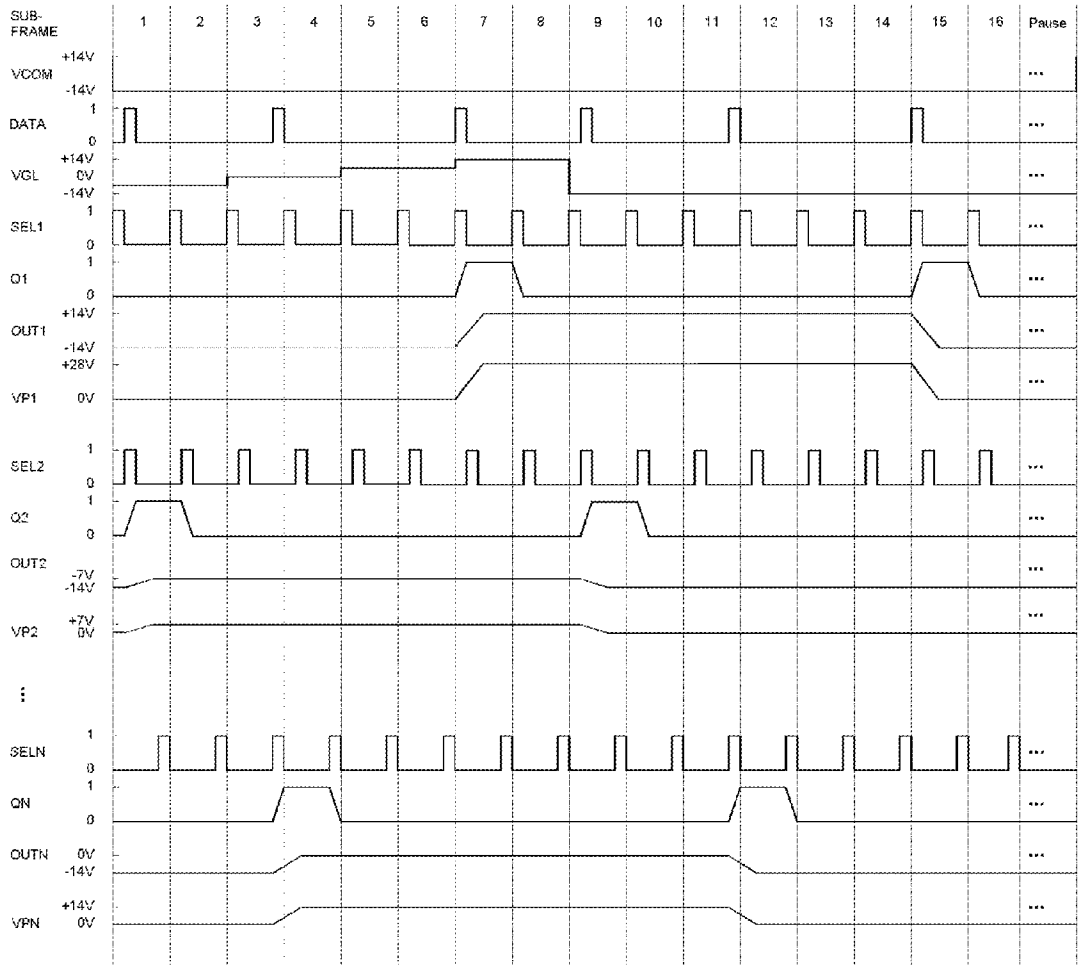
FIG. 8 provides still another potential drive scheme for implementing an amplitude modulated drive embodiment using the new pixel architecture.

The same method could be applied for a fast page turn (non-video) update. After a page erase to the planar texture, pulses of varying amplitudes could be applied to reduce the brightness of pixels to the desired gray levels. FIG. 8 demonstrates the amplitude modulation approach to apply a 28V pulse to the pixel in row 1, a 7V pulse to the pixel in row 2, and a 14V pulse to the pixel in row N. In this example, $V_{COM}$ is set to −14V and $V_{GL}$ is stepped in the following sequence: −7V, 0V, +7V, +14V, −14V.

For the row 1 pixel, the memory element is written to 1 in subframe 7 when $V_{GL}$=+14V in order to put 28V across the pixel. The memory element is written to 0 in subframe 8 with $V_{GL}$ still at +14V in order to turn off the switching element before $V_{GL}$ changes to −14V in subframe 9. The 28V pulse is held on the liquid crystal until subframe 15, when the memory element is programmed once again to turn on the switching element thus driving the pixel electrode to $V_{GL}$=$V_{COM}$=−14V and discharging the LC capacitance. In subframe 16 the memory is programmed to turn off the switching element such that $V_{GL}$ can be changed in a future subframe without affecting the pixel electrode.

The voltage pulses in rows 2 and rows N are similarly created. The only difference is that the pulses begin in subframes that have a different voltage on $V_{GL}$, thus creating pulses of different amplitudes on these pixels.

The new architecture thus permits the generation of amplitude modulation drive waveforms while avoiding the use of source drivers capable of high voltage amplitude modulation. The signal that would be amplitude modulated is $V_{GL}$, which can be handled simply for instance with digital potentiometers and op-amps.

Complex Waveforms

The new architecture also lends itself to additional types of complex drive waveforms not possible with traditional active matrix architectures. This is enabled by writing 1's to the memory elements for a subset of pixels in order to turn on their switching elements and then applying an arbitrarily complex waveform to $V_{GL}$. The pixel electrodes for all these pixels will track the voltage on $V_{GL}$. The drive waveform will thus be free from the timing constraints imposed by scanning an active matrix display. Waveform complexity will, however, typically be limited by the drive electronics used to create $V_{GL}$, RC time delays across the backplane, and the slew rates caused by the finite resistance of the switching elements.

Such an approach could be used, for example, to first select (by writing their respective memory elements to turn on their respective switching elements) all the pixels to be driven to the bright state and then applying an appropriate waveform to $V_{GL}$. Next, all of the pixels to be driven to the dark state could be selected, and a waveform for driving pixels dark applied to $V_{GL}$. This can be utilized to provide a very flexible scheme of driving the display. It may enable, for instance, the dynamic drive scheme for ChLCD in which a very short selection pulse, on the order of 1 ms, within the drive waveform determines the brightness of a pixel.

Serial Load Memory

An alternative addressing arrangement for the new pixel architecture provides for the possibility of decreasing the number of external connections to the display. In this alternative arrangement, rather than using select and data lines to address the memory elements, the memory elements may be arranged into a shift register, for example. Such structures have been demonstrated, for example, in the creation of gate drivers on the periphery of an active matrix array. By arranging the memory elements into a shift register, it would be possible to write all of the memory elements using only a small set control lines. This could greatly simplify the interface of the display to various devices.

As it may require some time to serially load all of the memory elements, this approach may be used to first select the pixels to receive a desired waveform, and then applying the waveform to $V_{GL}$. Then, another set of pixels can be selected to receive another desired waveform. The speed of loading the memory elements could be improved by arranging them into multiple shift registers that load in parallel, at a cost of more connections to the display. This design might be utilized to create a highly flexible display by reducing the number of external connections, which typically introduce rigidity.

Discrete Components

While the preceding discussion has assumed the context of thin film transistors fabricated directly on the display substrate, the approach could be applied to displays assembled from discrete components as well. For example, MOSFETs could be used instead of TFTs in the two-transistor (2T) model. The body diode in a MOSFET, however, typically prevents the direct replacement of a TFT with a MOSFET. This may be overcome by using two MOSFETS with their body diodes opposing each other (source of one connected to drain of the other) and gates connected as a replacement for each of the TFTs. Such an arrangement could be advantageous for driving a display with very large pixels (which may occur as the size of displays are increased). Additional arrangements will likely present themselves as technological advances change the preferred implementations in the future.

Also, note that dual-gate transistors can be utilized in place of standard transistors, by replacing the single transistor designs with two transistors configured in the dual-gate architecture, in any of the above embodiments in order to reduce leakage currents (because practical transistors don't tend to turn off perfectly), where leakage current reduction is desirable.

Note that any known method of fabricating TFT and/or display elements on one or more substrates could be utilized for the devices disclosed herein, utilizing such techniques as provided in *Liquid Crystals—Applications And Uses*, published by World Scientific, B Bahadur, Editor, Vol. 1, Chapter 15—Active Matrix LC Displays (by F. C. Luo), incorporated by reference, and *Amorphous Silicon Thin-Film Transistor Active-Matrix Reflective Cholesteric Liquid Crystal Display* published in Asia Display 98 by the assignee in conjunction with the University of Michigan, also incorporated by reference. Other techniques that might be useful are identified in U.S. Pat. No. 7,432,895B2 and U.S. patent application Ser. No. 12/089,942 (Pub. No. 2009/0189847A1), also incorporated by reference.

Accordingly, a number of possible approaches to achieving video rate ChLCD using active matrix backplanes based on a new pixel architecture are provided in this disclosure. Successful implementation of video rate ChLCD will typically utilize fast relaxing liquid crystal mixtures, with relatively low drive voltages also being desirable. The fast relaxation time is desired in order to achieve a high brightness from the time-averaged reflectance of the ChLCD in a video mode, while low drive voltages are useful in order to reduce TFT leakage currents and also to minimize drive pulsewidths. Aging of the TFTs might need to be compensated for, as the TFTs are frequently stressed in video modes and the gate voltages must support the threshold voltage drop across two TFTs instead of the one in a one-transistor architecture.

Furthermore, many or all of these various drives schemes are not limited to their application for ChLC display technology. Other LC technologies, along with new technologies such as e-ink displays, OLEDs, and potentially new display technologies could also utilize features disclosed herein to provide various benefits and advantages.

Finally, it is noted that a single display driver scheme could be provided that would be utilized by any of the variations discussed above. For example, a single driver designed to provide the option to be used for either the P-H PWM or Cumulative drive scheme and/or the amplitude modulation scheme could be commercially provided. Such a driver might be user configurable, so that the scheme most beneficial to a particular application can be chosen by the developer of the display, as desired.

Typically, in all such cases, the gate drivers would output a gate on/off voltage and the data drivers would need to output a data on/off voltage. The primary differences to be provided for are that the $V_{GL}$ drive electronics would switch $V_{GL}$ between 2 levels in the P-H PWM scheme, 3 levels in the cumulative PWM scheme, and numerous levels in any amplitude modulation scheme. It is anticipated that P-H PWM would work best for higher rate video applications, because in cumulative drive it takes multiple pulses to reach a stable gray level. The time required for these multiple pulses could lead to ghosting in the Cumulative drive mode. Cumulative drive could work nicely to smoothly change from one bistable image to another. However, better bistable images might be generated with an erase waveform followed by an amplitude modulated image write. This is probably the best implementation for an ebook page turn application, but it may appear more abrupt than a cumulative update. Nevertheless, the pixel architecture provided by this disclosure can be utilized for all of these various implementations by utilizing one of the embodiments disclosed above.

The invention has been described hereinabove using specific examples and embodiments; however, it will be understood by those skilled in the art that various alternatives may be used and equivalents may be substituted for elements and/or steps described herein, without deviating from the scope of the invention. Modifications may be necessary to adapt the invention to a particular situation or to particular needs without departing from the scope of the invention. It is intended that the invention not be limited to the particular implementations, uses, and embodiments described herein, but that the claims be given their broadest interpretation to cover all embodiments, literal or equivalent, disclosed or not, covered thereby.

What is claimed is:

1. A display device comprising:

a plurality of individually driven display elements; and a plurality of driving elements, each one of said driving elements for driving an associated one of said display elements, each one of said driving elements including:

a storage element for storing an on/off state; and a switching element connected to the associated display element for connecting said associated display element to a source voltage, said connecting based on the state of said storage element, wherein said source voltage is varied between at least two different voltages during an update of a state of the associated display element.

2. The display device of claim 1, wherein said display device is a bistable display.

3. The display device of claim 1, wherein said display device is a cholesteric liquid crystal display.

4. The display device of claim 1, wherein when said storage element is storing an "ON" state, the switching element is applying a selected voltage source across said associated element of the display, whereas when said storage element is storing an "OFF" state, said switching element removes said selected voltage source from said associated element of the display.

5. The display device of claim 4, wherein said selected voltage source is varied during said "ON" state.

6. The display device of claim 4, wherein said selected voltage source is varied during said "OFF" state.

7. The display device of claim 1, wherein said selected voltage source is amplitude modulated such that the voltage amplitude is changed during said "ON" state.

8. The display device of claim 4, wherein said display is a cholesteric liquid crystal display, and wherein said selected voltage is about equal to or greater than ±14 volts.

9. The display device of claim 1, wherein said storage element is comprised of at least one transistor connected to a capacitor, and wherein said switching element is comprised of at least one transistor having an input directly connected to an output of said storage element.

10. The display device of claim 9, wherein said switching element connects and disconnects said corresponding display element to a voltage source based on the state of said storage element.

11. The display device of claim 1, wherein the storage elements of said plurality of driving elements are provided by a memory device.

12. The display device of claim 1, wherein said storage elements of said plurality of driving elements are arranged into at least one shift register.

13. The display device of claim 1, wherein the storage elements of said plurality of driving elements are arranged into a memory having states set using address and data inputs.

14. A display device comprising:

a plurality of individually driven display elements; and a plurality of driving elements arranged as a matrix, each one of said driving elements for driving an associated one of said display elements, each one of said driving elements including:

a first thin-film transistor for storing an "ON" or "OFF" state; and a second thin-film transistor connected to the associated display element for connecting said associated display element to a source voltage, said connecting based on the "ON" or "OFF" state stored by said first transistor.

15. The display device of claim 14, further comprising a capacitor attached to said first thin-film transistor, where said first thin-film transistor and said capacitor form a storage device for storing the "ON" or "OFF" state, where said connecting said associated display element to a source voltage by said second thin-film transistor is based on the current state of said storage device.

16. The display device of claim 15, wherein said individually driven display elements are comprised of a cholesteric liquid crystal material having bistable properties.

17. The display device of claim 14, wherein one or both of said first thin-film transistor and said second thin-film transistor is arranged as a dual-gate transistor to reduce leakage currents.

18. A display device comprising:

a plurality of individually driven display elements; and a plurality of driving elements, each one of said driving elements for driving an associated one of said display elements, each one of said driving elements including:

a first input;

a second input;

a storage element for storing an on/off state for at least a certain period of time, wherein said on/off state is based on data provided at said first input and second input; and a switching element including an input connected to a voltage source, said switching element for driving the associated display element based on the state of said storage element such that when said storage element transitions to an "ON" state, the switching element connects a voltage source to said associated display element to apply a charge to said associated display element, whereas when said storage element thereafter transitions to an "OFF" state, said switching element removes said voltage source from said associated element of the display while substantially maintaining the charge on said display element.

19. The display device of claim 18, wherein said voltage source is held substantially constant during said "ON" state.

20. The display device of claim 18, wherein said voltage source is varied during said "ON" state.

21. The display device of claim 20, wherein said voltage source is amplitude modulated such that the voltage amplitude is changed during said "ON" state.

22. The display device of claim 18, wherein said voltage source is amplitude modulated such that the voltage amplitude is changed during said "OFF" state 23. The display device of claim 18, wherein said voltage source is toggled between a positive value during a first "ON" state and a negative value during a second "ON" state with at least one intervening "OFF" state being provided between said first "ON" state and said second "ON" state.

24. The display device of claim 18, wherein, during a refresh period, a regular series of voltage pulses is provided to said first input, and wherein an series of differently spaced voltage pulses are provided to said second input.

25. A display device comprising:

a plurality of cholesteric liquid crystal display elements arranged as a matrix of columns and rows; and a plurality of driving elements, each one of said driving elements for driving an associated one of said display elements, each one of said driving elements including:

a storage element for storing an "ON"/"OFF" state for at least a certain period of time, said storage element having a column input and a row input, wherein said on/off state is based on a signal provided at said column input and a different signal provided at said row input; and a switching element for driving the associated display element based on the state of said storage element, such that when said storage element is storing an "ON" state, the driving element applies a selected voltage source across said associated element of the display, whereas when said storage element is storing an "OFF" state, said switching element removes said selected voltage source from said associated element of the display;

wherein the column inputs of the storage elements of said plurality of driving elements that are in the same column are tied to a common column signal source, and wherein the row inputs of the storage elements of said plurality of driving elements that are in the same row are tied to a common row signal source, and wherein the row signal sources and column signal sources are used to set the state of the storage elements to set a reflectance and/or transmittance of the associated display elements to generate a display image on said display.

26. The display device of claim 25, wherein said row, column, and voltage sources are provided in a manner such that said reflectance and/or transmittance of each of the display elements are varied for providing a plurality of gray scales by controlling a transition of the liquid crystal of the display element from a homeotropic to a planar state.

27. The display device of claim 25, wherein said row, column, and voltage sources are provided in a manner such that said reflectance and/or transmittance of each of the display elements are varied by varying a voltage applied to the liquid crystal of the display element while the liquid crystal is primarily maintained in a planar state.

28. The display device of claim 25, wherein said row, column, and voltage sources are provided in a manner such that said reflectance and/or transmittance of each of the display elements are varied by varying a voltage applied to the liquid crystal to control transitions between the planar state and the homeotropic state.

29. The display device of claim 25, wherein said display device is arranged on a backplane with said display elements and associated driving elements arranged in a plurality of rows, and wherein while a first set of N rows are in an idle time to allow the cholesteric liquid crystal material to relax, addressing a second set of N rows during said idle time.

30. The display device of claim 29, wherein during said idle time, addressing a third set of N rows.

31. The display device of claim 25, wherein said row, column, and voltage sources are provided in a manner such that said reflectance and/or transmittance of each of the display elements are varied by applying corresponding sequences of voltage pulses to each of said display elements whose root mean square amplitudes are adjusted to select the desired gray scale levels of the associated display elements.

32. The display device of claim 31, wherein the root mean square amplitudes of the pulses are controlled through amplitude modulation.

33. The display device of claim 31, wherein the root mean square amplitudes of the pulses are controlled through pulse width modulation.

34. A display device comprising:

a plurality of individually driven display elements; and a plurality of driving elements, each one of said driving elements for driving an associated one of said display elements, each one of said driving elements including:

a first input;

a second input;

a storage element for storing an on/off state for at least a certain period of time, wherein said on/off state is based on data provided at said first input and second input; and a switching element including an input connected to a voltage source, said switching element for driving the associated display element based on the state of said storage element such that when said storage element transitions to an "ON" state, the switching element connects a voltage source to said associated display element to set a state of the associated display element, whereas when said storage element thereafter transitions to an "OFF" state, said switching element removes said voltage source from said associated element of the display while substantially maintaining the state of the display element.

* * * * *